US009551270B2

(12) United States Patent
Kitayama

(10) Patent No.: US 9,551,270 B2
(45) Date of Patent: Jan. 24, 2017

(54) CONTROL DEVICE FOR COOLANT FLOW IN AN INTERNAL COMBUSTION ENGINE

(71) Applicant: Takeshi Kitayama, Susono (JP)

(72) Inventor: Takeshi Kitayama, Susono (JP)

(73) Assignee: TOYOTA JIDOSHA KABUSHIKI KAISHA, Toyota-Shi (JP)

( * ) Notice: Subject to any disclaimer, the term of this patent is extended or adjusted under 35 U.S.C. 154(b) by 0 days.

(21) Appl. No.: 14/774,332

(22) PCT Filed: Feb. 12, 2013

(86) PCT No.: PCT/JP2013/053275
§ 371 (c)(1),
(2) Date: Jan. 13, 2016

(87) PCT Pub. No.: WO2014/125570
PCT Pub. Date: Aug. 21, 2014

(65) Prior Publication Data

US 2016/0010597 A1 Jan. 14, 2016

(51) Int. Cl.
*F01P 7/16* (2006.01)
*F01P 3/20* (2006.01)
*F01P 5/10* (2006.01)

(52) U.S. Cl.
CPC .. *F01P 7/16* (2013.01); *F01P 3/20* (2013.01); *F01P 5/10* (2013.01); *F02M 26/28* (2016.02); *F02M 26/33* (2016.02); *F02M 26/41* (2016.02); *F01P 2060/16* (2013.01); *F02M 26/22* (2016.02)

(58) Field of Classification Search
CPC ..... F02M 25/0738; F02M 26/22–26/33; F01P 5/10; F01P 7/16
USPC ..... 701/108; 60/298; 123/568.12, 542
See application file for complete search history.

(56) References Cited

U.S. PATENT DOCUMENTS 5,732,688 A * 3/1998 Charlton ..... F02D 21/08 123/568.12
6,321,697 B1 * 11/2001 Matsuda ..... F01P 7/165 123/41.29
9,032,787 B2 * 5/2015 Peters ..... F01N 11/00 73/114.01
2007/0131207 A1 6/2007 Nakamura
2010/0270011 A1 10/2010 Takahashi et al.
(Continued)

FOREIGN PATENT DOCUMENTS

CN 1982689 6/2007
DE 60006612 T2 9/2004
(Continued)

*Primary Examiner* — Stephen K Cronin
*Assistant Examiner* — Robert Werner
(74) *Attorney, Agent, or Firm* — Andrews Kurth Kenyon LLP

(57) ABSTRACT

A control device for an internal combustion engine is a control device, applied to an internal combustion engine including an EGR cooler which includes a heat exchange body made of a material including SiC. The control device includes a control unit that controls a flow rate of coolant passing through an EGR cooler to be small in a case of a temperature of the coolant not less than a predetermined value in ending the coolant stop control of the coolant stop control unit, as compared with a case of a temperature of the coolant less than the predetermined value in ending the coolant stop control of the coolant stop control unit.

3 Claims, 9 Drawing Sheets

(56) References Cited

U.S. PATENT DOCUMENTS

| | | | | |
|---|---|---|---|---|
| 2013/0186377 | A1* | 7/2013 | Ryan | F01P 3/12<br>123/568.12 |
| 2013/0213620 | A1 | 8/2013 | Miyazaki et al. | |
| 2015/0068472 | A1* | 3/2015 | Sakagawa | F01P 7/165<br>123/41.31 |

FOREIGN PATENT DOCUMENTS

| | | | |
|---|---|---|---|
| JP | 2008-002395 | A | 1/2008 |
| JP | 2008-274826 | A | 11/2008 |
| JP | 2010-2 71031 | A | 12/2010 |
| JP | 2010-285894 | A | 12/2010 |
| JP | 2011-017296 | A | 1/2011 |
| JP | 2011-099370 | A | 5/2011 |
| WO | 2012/043758 | A | 4/2012 |

* cited by examiner

CONTROL DEVICE FOR COOLANT FLOW IN AN INTERNAL COMBUSTION ENGINE

CROSS-REFERENCE TO RELATED APPLICATION

This is a national phase application based on the PCT International Patent Application No. PCT/JP2013/053275 filed Feb. 12, 2013, the entire contents of which are incorporated herein by reference.

TECHNICAL FIELD

The present invention is related to a control device for an internal combustion engine.

BACKGROUND ART

Conventionally, there is known EGR (Exhaust Gas Recirculation) for recirculating a part of exhaust gas discharged from a cylinder of an engine body of an internal combustion engine to an intake passage. Moreover, there is conventionally known an EGR cooler as a device for cooling the exhaust gas recirculated to the cylinder. The EGR cooler is arranged in an EGR passage for recirculating the part of the exhaust gas discharged from the cylinder to the intake passage, and cools the exhaust gas passing through the EGR passage (hereinafter referred to as EGR gas in some cases) by a coolant. The internal combustion engine includes the EGR cooler, so it is possible to prevent the temperature of the EGR gas from being too high.

Patent Document 1 discloses a heat exchanger including a heat exchange body (which is called honeycomb structure in Patent Document 1) including plural gas passages. When the heat exchanger according to Patent Document 1 is arranged in the EGR passage such that the EGR gas passes through the heat exchange body according to Patent Document 1, the heat exchanger according to Patent Document 1 exerts the function as the EGR cooler. Also, Patent Document 1 discloses a material including SiC used as the material of the heat exchanger.

In caparison with a metal such as a stainless steel, SiC has a good thermal conductivity and a good corrosion resistance to the exhaust gas. When the heat exchanger including the heat exchange body made of the material including SiC according to Patent Document 1 is used as the EGR cooler, it can be considered to improve the cooling performance and the corrosion resistance of the EGR cooler.

PRIOR ART DOCUMENT

Patent Document

[Patent Document 1] Japanese Unexamined Patent Application Publication No. 2010-271031

SUMMARY OF THE INVENTION

Problems to be Solved by the Invention

Meanwhile, in the internal combustion engine including the EGR cooler, a coolant flowing through the engine body of the internal combustion engine is also used as a coolant for the EGR cooler in some cases. In such an internal combustion engine, when the coolant stops being supplied to the engine body in order to, for example, accelerate the warming-up of the internal combustion engine, the coolant stops flowing into the EGR cooler (hereinafter, this is referred to as coolant stop control). When the heat exchange body is heated by the EGR gas to have a high temperature in executing the coolant stop control, it is considered that the temperature of the heat exchanger reaches a predetermined value or more. In a case of ending the coolant stop control in such a state, when the coolant flows into the EGR cooler at a predetermined flow rate, the temperature of the heat exchanger might suddenly decrease.

Herein, SiC has a property that a drastic change in the temperature also drastically changes the strength. The following will specifically describe this with reference to a drawing. FIG. 9 is a schematic view of a change in strength of SiC with temperature. The vertical axis in FIG. 9 indicates the strength of SiC. The horizontal axis indicates the value (temperature difference) obtained by subtracting the temperature of the SiC from the reference temperature, and it can be seen that the degree of decrease in the temperature of the SiC increases as it goes to the right side. As illustrated in FIG. 9, SiC has a property in that its strength suddenly decreases as its temperature suddenly decreases. Thus, in the case of using the heat exchange body made of a material including SiC as the heat exchange body of the EGR cooler, when the temperature of the heat exchange body suddenly decreases in a case of ending the coolant stop control mentioned above, the strength of the exchange body also suddenly decreases, which might result in deterioration in the heat exchange body.

The present invention has an object to provide a control device for an internal combustion engine capable of suppressing deterioration in a heat exchange body made of a material including SiC.

Means for Solving the Problems

In a control device for an internal combustion engine according to the present invention, the control device that is applied to the internal combustion engine including an EGR cooler which is arranged in an EGR passage introducing an EGR gas into an intake passage of the internal combustion engine and which includes a heat exchange body made of a material including SiC, the control device includes: a coolant stop control unit that executes coolant stop control to stop a coolant from flowing into the EGR cooler; and a control unit that controls a flow rate of the coolant passing through the EGR cooler to be small in a case of a temperature of the coolant not less than a predetermined value in ending the coolant stop control of the coolant stop control unit, as compared with a case of a temperature of the coolant less than the predetermined value in ending the coolant stop control of the coolant stop control unit.

With the control device for the internal combustion engine according to the present invention, a degree to which the coolant cools the heat exchange body can be reduced in ending the coolant stop control. This can reduce the temperature decrease speed of the heat exchange body in ending the coolant stop control. As a result, a sudden decrease in the temperature of the heat exchange body can be suppressed in ending the coolant stop control, thereby suppressing the deterioration in the heat exchange body.

In the above configuration, the internal combustion engine may include a pump that supplies a coolant to an engine body and the EGR cooler, and the control unit may reduce output of the pump, in a case of the temperature of the coolant not less than the predetermined value in ending the coolant stop control of the coolant stop control unit, as compared with a case of the temperature of the coolant less than the predetermined value in ending the coolant stop control of the coolant stop control unit. With this configuration, the flow rate of the coolant passing through the EGR cooler can be controlled to be small, in the case of the temperature of the coolant not less than the predetermined value in ending the coolant stop control of the coolant stop control unit, as compared with the case of the temperature of the coolant less than the predetermined value in ending the coolant stop control of the coolant stop control unit. Thereby, it is possible to suppress the deterioration in the heat exchange body.

In the above configuration, the control unit may gradually change output of the pump into target output, when reducing output of the pump. With this configuration, the sudden decrease in the temperature of the heat exchange body can be effectively suppressed. It is thus possible to suppress the deterioration in the heat exchange body.

Effects of the Invention

According to the present invention, it is possible to provide a control device for an internal combustion engine capable of suppressing deterioration in a heat exchange body made of a material including SiC.

MODES FOR CARRYING OUT THE INVENTION

The following will describe embodiments according to the present invention.

First Embodiment

A description will be given of a control device 10 for an internal combustion engine according to the first embodiment of the present invention. First, a description will be given of the overall structure of an internal combustion engine 5 to which the control device 10 is applied, and a detailed description will be given of the control device 10.

Figure 1:
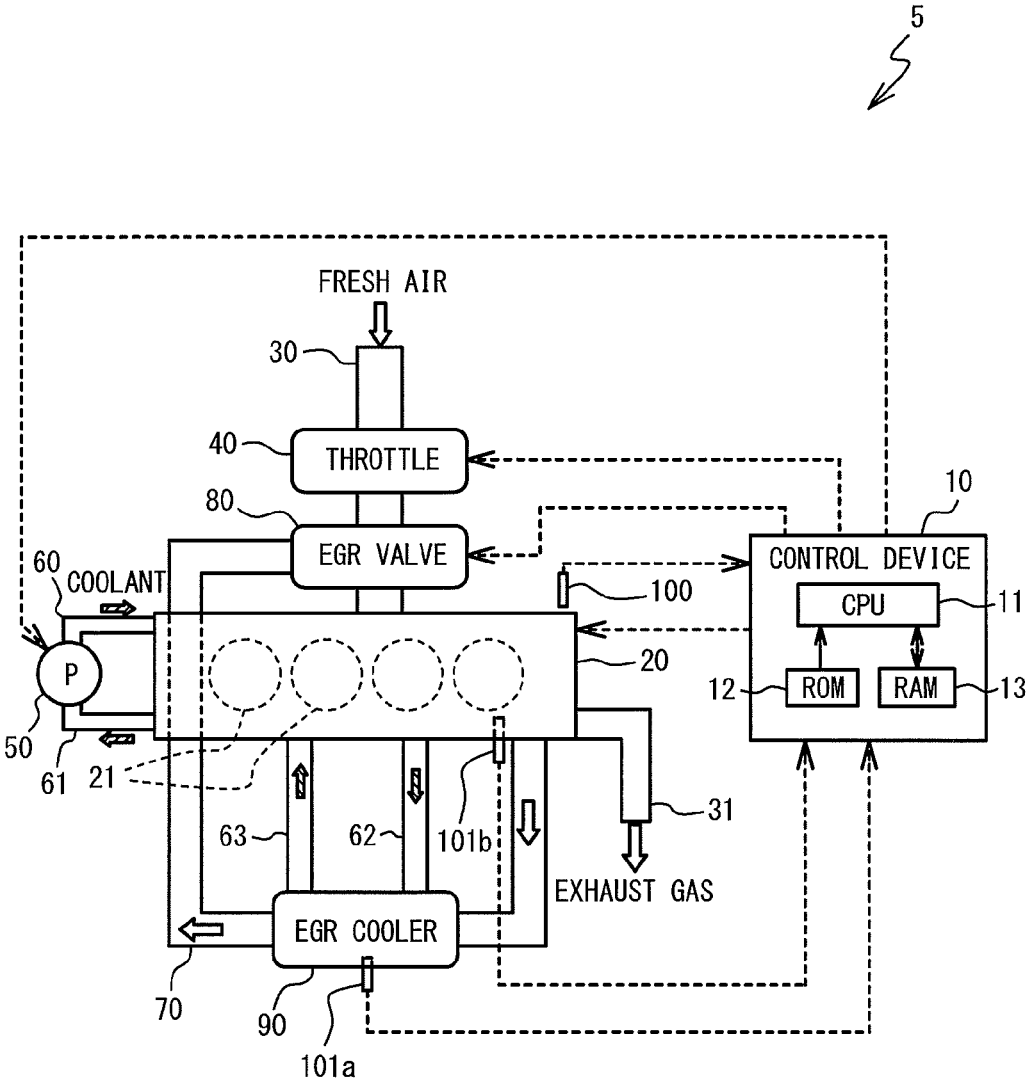
FIG. 1 is a schematic view of an internal combustion engine to which a control device according to the first embodiment is applied.

FIG. 1 is a schematic view of the internal combustion engine 5 to which the control device 10 is applied. A type of the internal combustion engine 5, not specifically limited, may be a diesel engine, a gasoline engine or other various internal combustion engines. The embodiment uses the gasoline engine as an example of the internal combustion engine 5. The internal combustion engine 5 includes the control device 10, an engine body 20 formed with cylinders 21, an intake passage 30 connected to the cylinders 21, an exhaust passage 31 connected to the cylinders 21, and a throttle 40 arranged in the intake passage 30. In addition, the intake passage 30 is a passage through which intake air passes. In the embodiment, fresh air flows into an end portion of the upstream side of the intake passage 30 in the intake flowing direction. Also, the engine body 20 includes a cylinder block formed with the cylinders 21, a cylinder head arranged on a top portion of the cylinder block, and pistons arranged in the cylinders 21.

Further, the internal combustion engine 5 includes a pump 50 for supplying the coolant. The internal combustion engine 5 includes a first supply passage 60, a first discharge passage 61, a second supply passage 62, and a second discharge passage 63, as coolant passages through which the coolant flows. Furthermore, the internal combustion engine 5 includes an EGR (Exhaust Gas Recirculation) passage 70, an EGR valve 80 arranged in the EGR passage 70, and an EGR cooler 90 arranged in the EGR passage 70. Moreover, the internal combustion engine 5 includes a crank position sensor 100, a temperature sensor 101*a*, and a temperature sensor 101*b*.

The control device 10 is a device for controlling the engine body 20, the throttle 40, the pump 50, and the EGR valve 80. The embodiment uses an electronic control unit (Electronic Control Unit) including a CPU (Central Processing Unit) 11, a ROM (Read Only Memory) 12, and a RAM (Random Access Memory) 13, as an example of the control device 10. The CPU 11 controls the engine body 20, the throttle 40, the pump 50, and the EGR valve 80. The CPU 11 executes steps of a flowchart described later. The ROM 12 and the RAM 13 function as a storage unit for storing information necessary for the operation of the CPU 11.

The coolant discharged from the pump 50 passes through the first supply passage 60 to a coolant passage formed within the engine body 20 (hereinafter sometimes referred to as engine body coolant passage). The coolant through the engine body coolant passage returns to the pump 50 through the first discharge passage 61. Also, a part of the coolant in the engine body coolant passage is introduced to the EGR cooler 90 through the second supply passage 62. The coolant through the EGR cooler 90 returns to the engine body coolant passage through the second discharge passage 63. The pump 50 according to the embodiment supplies the coolant to both the engine body 20 and the EGR cooler 90. Additionally, the embodiment uses an electric water pump as an example of the pump 50.

The EGR passage 70 is a passage for recirculating a part of the exhaust gas discharged from the cylinders 21 to the intake passage 30. Hereinafter, the exhaust gas passing through the EGR passage 70 and being recirculated to the intake passage 30 is referred to as EGR gas. That is, the EGR passage 70 is a passage for introducing the EGR gas into the intake passage 30. The EGR passage 70 according to the embodiment connects a part of the intake passage 30 with a part of the exhaust passage 31. Also, the upstream end of the EGR passage 70 in the EGR gas flow direction is connected to the exhaust manifold of the exhaust passage 31. Further, a portion of the downstream side of the EGR passage 70 with respect to the EGR cooler 90 passes through the inside of the engine body 20 (the cylinder block in the embodiment).

The EGR valve 80 opens and closes the EGR passage 70 in response to instructions from the control device 10. The EGR valve 80 opens and closes the EGR passage 70 to adjust the flow rate of the EGR gas ($m^3/s$). When the EGR valve 80 opens (specifically, when the opening degree of the EGR valve 80 is greater than zero), the EGR gas starts flowing into the cylinders 21. When the EGR valve 80 closes, the EGR gas stops flowing into the cylinders 21. Also, the larger the opening degree of the EGR valve 80, the greater the flow rate of the EGR gas flowing into the cylinders 21. The EGR cooler 90 is a device for cooling the EGR gas by exchanging heat between the coolant and the EGR gas. The EGR cooler 90 will be described later in detail.

The crank position sensor 100 detects a position of the crankshaft of the internal combustion engine 5 and transmits the detection result to the control device 10. The temperature sensor 101*a* detects a temperature of the coolant in a cooler coolant passage 94 as a coolant passage formed within the EGR cooler 90 (illustrated in FIG. 2A to be described later) and transmits the detection result to the control device 10. The temperature sensor 101*b* detects a temperature of the exhaust gas and transmits the detection result to the control device 10. The temperature sensor 101*b* according to the embodiment detects the temperature of the exhaust gas in the upstream side with respect to the EGR cooler 90.

Figure 2A:
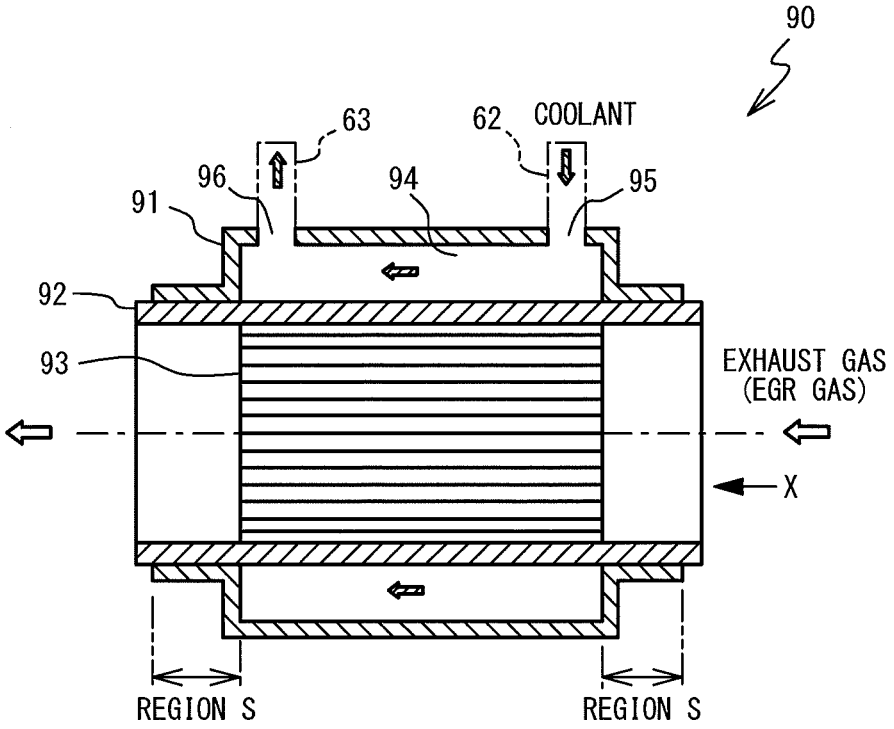
FIG. 2A is a schematic sectional view of an EGR cooler.

Next, the structure of the EGR cooler 90 will be described. FIG. 2A is a schematic sectional view of the EGR cooler 90. The EGR cooler 90 includes an outer pipe 91, an inner pipe 92 arranged within the outer pipe 91, and a heat exchange body 93 arranged within the inner pipe 92. The inner pipe 92 is connected to the EGR passage 70 such that the EGR gas passes through the inner pipe 92. The flow direction of the EGR gas is a direction from right to left in FIG. 2A.

Portions, illustrated as regions S in FIG. 2A, of end portions of the outer pipe 91 are connected to an outer circumferential surface of the inner pipe 92. A space is provided between the inner pipe 92 and a region sandwiched between the regions S positioned at both end portions of the outer pipe 91. This space is the cooler coolant passage 94 serving as the coolant passage through which the coolant passes. Note that the regions S function as sealing portions for suppressing leakage of the coolant from the cooler coolant passage 94. At a portion forming the cooler coolant passage 94 in the outer pipe 91, a coolant supply port 95 and a coolant discharge port 96 are provided. The second supply passage 62 is connected to the coolant supply port 95, and the second discharge passage 63 is connected to the coolant discharge port 96. The inner pipe 92 covers the entire circumferential wall surface of the heat exchange body 93. The inner pipe 92 according to the embodiment further extends to the upstream side beyond an end face of the heat exchange body 93 located on the upstream side in the EGR gas flow direction, and further extends to the downstream side beyond an end face of the heat exchange body 93 located on the downstream side in the EGR gas flow direction.

Figure 2B:
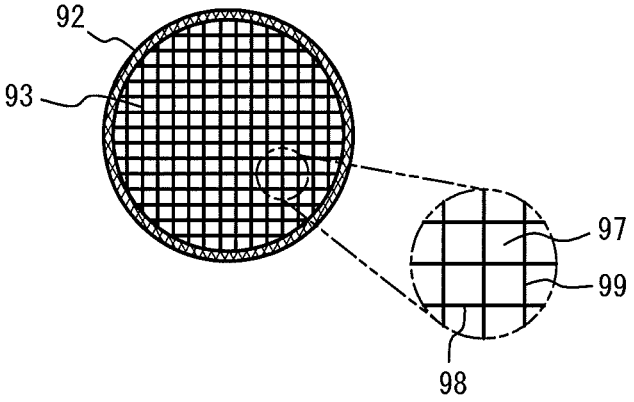
FIG. 2B is a front view of a heat exchange body.

The heat exchange body 93 is a medium for conducting heat of the EGR gas to the cooler coolant passage 94. FIG. 2B is a front view of the heat exchange body 93. Specifically, FIG. 2B schematically illustrates the heat exchange body 93 when viewed in the X direction. Also, FIG. 2B illustrates the inner pipe 92. The heat exchange body 93 according to the embodiment is arranged within the inner pipe 92 so as to contact with the inner circumferential surface of the inner pipe 92. Specifically, the outer diameter value of the heat exchange body 93 is designed to be equal to or slightly larger than the inner diameter value of the inner pipe 92. Accordingly, the heat exchange body 93 according to the embodiment is arranged within the inner pipe 92 to fit into the inner circumferential surface of the inner pipe 92.

The heat exchange body 93 includes gas passages 97 through which the EGR gas passes. The number of the gas passages 97 according to the embodiment is plural. As illustrated in an enlarged view in a lower right of FIG. 2B, each gas passage 97 is defined by a first partition 98, extending in the transverse direction in FIG. 2B, and a second partition 99, having a predetermined angle (90 degrees as an example in the embodiment) with respect to the first partition 98. When the EGR gas flows into the gas passages 97, the heat of the EGR gas is conducted to each of the first partitions 98 and the second partitions 99 to be conducted to the inner pipe 92, and then being deprived by the coolant in the cooler coolant passage 94. In this way, the EGR cooler 90 exchange heat between the EGR gas and the coolant in the cooler coolant passage 94.

A material of the outer pipe 91 and the inner pipe 92 according to the embodiment is stainless steel. The material of the outer pipe 91 and the inner pipe 92 is, however, not limited thereto and can be, for example, a metal other than stainless steel or ceramic. The material of the heat exchange body 93 according to the embodiment is ceramic including SiC (silicon carbide). Specifically, the material of the first partition 98 and the second partition wall 99 of the heat exchange body 93 includes SiC. Specific examples of the material of the heat exchange body 93 such as SiC (that is, SiC with no additive), Si-impregnated SiC, (Si+Al), impregnated SiC, and metal composite SiC, that is, various type materials mainly composed of SiC can be used. In the embodiment, as an example of the material of the heat exchange body 93, Si-impregnated SiC is used.

Next, the control of the control device 10 will be described. The control device 10 executes the control processing for stopping the operation of the pump 50 for a predetermined period (hereinafter, this control processing is referred to as coolant stop control). When the coolant stop control is executed, the coolant stops being supplied from the pump 50 to the engine body 20, and the coolant stops flowing to the EGR cooler 90 (specifically, the cooler coolant passage 94) through the engine body 20. That is, the coolant stop control according to the embodiment is the control processing for stopping the operation of the pump 50, and is also the control processing for stopping the coolant from flowing to the EGR cooler 90 through the engine body 20. Since the execution of the coolant stop control stops the coolant from flowing in the engine body 20, it is possible to quickly warm up the engine body 20. It is thereby possible to accelerate the warming up of the internal combustion engine 5.

The timing when the control device 10 according to the embodiment executes the coolant stop control is the starting up of the internal combustion engine 5. Also, a period required to warm up the internal combustion engine 5 is applicable to a predetermined period during the execution of the coolant stop control. This predetermined period, previously obtained by experiments, simulations, or the like, is stored in the storage unit of the control device 10. The control device 10 according to the embodiment stops the operation of the pump 50 for a predetermined period from when the internal combustion engine 5 starts up (specifically, from when cranking starts), thereby executing the coolant stop control for a predetermined period in starting up the internal combustion engine 5. The timing when the control device 10 executes the control stop coolant is, however, not to limited to such a timing when the internal combustion engine 5 starts up. Additionally, a predetermined period during the execution of the coolant stop control is also not limited to such an above described period.

The specific fashion for executing the coolant stop control is not limited to the fashion for stopping the operation of the pump 50 as described above. As another example, for example, in a case of the internal combustion engine 5 provided with a flow rate control valve in a coolant passage (specifically, the first supply passage 60 or the first discharge passage 61) between the pump 50 and the engine body 20, the control device 10 may control the flow rate control valve to close without stopping the operation of the pump 50. Also in this case, the closing of the flow rate control valve can stop the coolant from flowing in the engine body 20, thereby also stopping the coolant from flowing to the EGR cooler 90 through the engine body 20.

Further, the control device 10 according to the embodiment executes control processing (hereinafter referred to as temperature control) for suppressing the degree of a change in the temperature of the heat exchange body 93 in a case of ending the coolant stop control. Note that the change in the temperature of the heat exchange body 93 specifically means a change in the temperature of the heat exchange body 93 with time. The following will describe the temperature control according to the embodiment in detail with reference to a flowchart.

Figure 3:
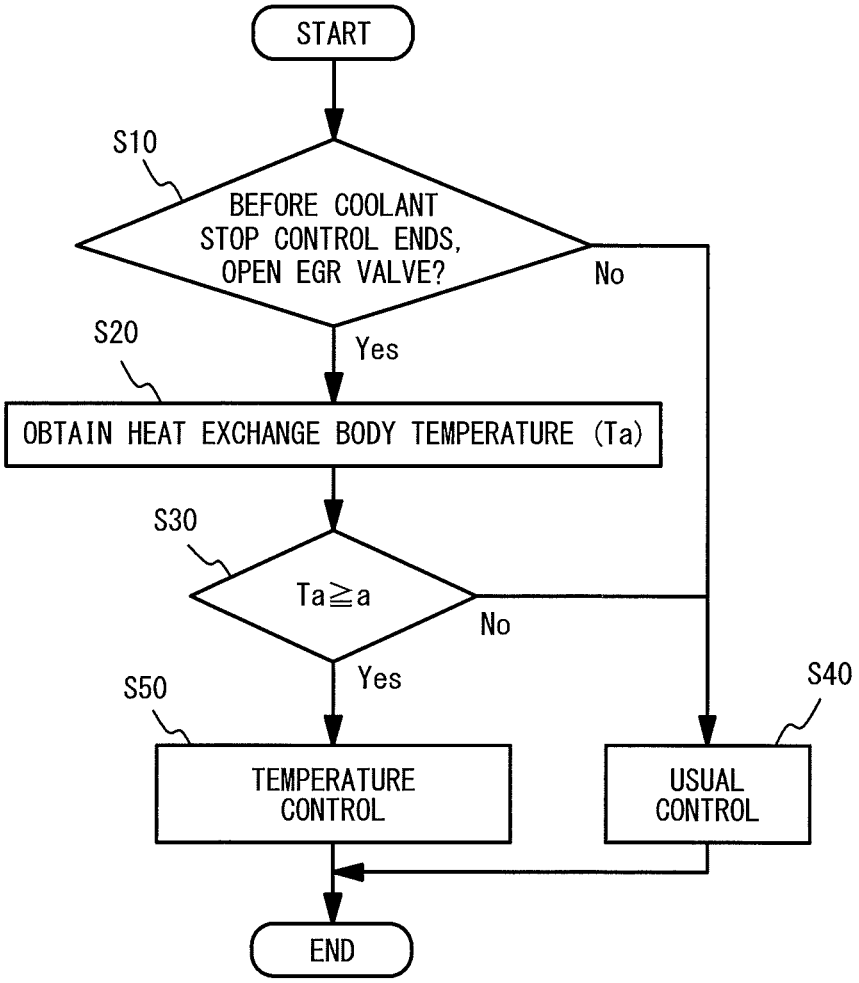
FIG. 3 is a view illustrating an example of a flowchart of temperature control executed by the control device according to the first embodiment.

FIG. 3 is a view illustrating an example of the flowchart of the temperature control executed by the control device 10 according to the embodiment. The control device 10 (specifically, the CPU 11) according to the embodiment executes the first start illustrated in FIG. 3 in starting up the internal combustion engine 5. The control device 10 repeatedly executes the flowchart of FIG. 3 in a predetermined cycle. First, the control device 10 determines whether or not the EGR valve 80 opens (step S10). When No is determined in step S10, the control device 10 executes step S40 described later.

When Yes is determined in step S10, the control device 10 obtains the temperature of the heat exchange body 93 (Ta) (step S20). In addition, step S20 is executed before the coolant stop control ends. In other words, in step S20, the control device 10 obtains the temperature of the heat exchange body 93 before the coolant stop control ends. The control device 10 according to the embodiment obtains the temperature of the heat exchange body 93 on the basis of an index correlating with the temperature of the heat exchange body 93. Specifically, the control device 10 uses, as an example of the index correlating with the temperature of the heat exchange body 93, the temperature of the exhaust gas existing in the upstream side with respect to the heat exchange body 93 (hereinafter sometimes referred to as upstream exhaust gas temperature). The control device 10 obtains the upstream exhaust gas temperature based on the detection result of the temperature sensor 101*b*. Also, in the storage unit of the control device 10, a map defining a relationship between the temperature of the heat exchange body 93 and the upstream exhaust gas temperature is stored. The control device 10 selects, from the map in the storage unit, the temperature of the heat exchange body 93 corresponding to the upstream exhaust gas temperature obtained based on the detection result of the temperature sensor 101*b*, and obtains the selected temperature of the heat exchange body 93 as the temperature of the heat exchange body 93 (Ta) in step S20. The specific fashion for obtaining the temperature of the heat exchange body 93 (Ta) is not specifically limited to such a fashion for obtaining it based on the index. As another example, for example, in a case of the internal combustion engine 5 provided with a temperature sensor for directly detecting the temperature of the heat exchange body 93, the control device 10 can detect the temperature of the heat exchange body 93 on the basis of the detection result of the temperature sensor.

After step S20, the control device 10 determines whether or not the temperature of the heat exchange body 93 (Ta) obtained in step S20 is not less than a predetermined value a (step S30). When No is determined in step S30 (when the temperature of the heat exchange body 93 is less than the predetermined value a), the control device 10 executes usual control (step S40). In the usual control in step S40, the control device 10 controls the flow rate of the coolant, which passes through the EGR cooler 90 after the coolant stop control ends, to be a predetermined flow rate (hereinafter referred to as usual flow rate). The control device 10, specifically, by controlling a duty ratio of the pump 50, controls the flow rate of the coolant, which passes through the cooler coolant passage 94 of the EGR cooler 90 after the coolant stop control ends, to be the usual flow rate. The control device 10, more specifically, controls the duty ratio of the pump 50 so as to control the output of the pump 50 (specifically, rotation speed) to be the output corresponding to the usual flow rate (hereinafter referred to as usual output). Subsequently, the control device 10 ends the execution of the flow chart.

When Yes is determined in step S30 (that is, when the temperature of the heat exchange body 93 is not less than the predetermined value a), the control device 10 executes the temperature control (step S50). The control device 10 specifically controls the flow rate of the coolant passing through the EGR cooler 90 to be smaller than the usual flow rate, after the coolant stop control ends. That is, the control device 10 controls the flow rate of the coolant passing through the EGR cooler 90 to be small, in a case of the temperature of the heat exchange body 93 not less than the predetermined value a in ending the coolant stop control of the control device 10, as compared with a case of the temperature of the heat exchange body 93 less than the predetermined value a in ending the coolant stop control of the control device 10.

Specifically, in step S50, the control device 10 controls the duty ratio of the pump 50 to reduce the output of the pump 50 (specifically, rotational speed), as compared with the usual output that is the output of the pump 50 in executing step S40. In other words, the control device 10 reduces the output of the pump 50 in the case of the temperature of the heat exchange body 93 not less than the predetermined value a in ending the coolant stop control of the control device 10, as compared with the output of the pump 50 in the case of the temperature of the heat exchange body 93 less than the predetermined value a in ending the coolant stop control of the control device 10. This configuration can control the flow rate, of the coolant passing through the EGR cooler 90, to be small in the case of the temperature of the heat exchange body 93 not less than the predetermined value a in ending the coolant stop control of the control device 10, as compared with the case of the temperature of the heat exchange body 93 less than the predetermined value a in ending the coolant stop control of the control device 10. In addition, the control device 10 executes the temperature control for a predetermined period in step S50.

Further, when reducing the output of the pump 50 in the case of the temperature of the heat exchange body 93 not less than the predetermined value a in ending the coolant stop control of the control device 10 in comparison with the output of the pump 50 in the case of the temperature of the heat exchange body 93 less than the predetermined value a in ending the coolant stop control of the control device 10, the control device 10 does not drastically (that is, not rapidly) change the output of the pump 50 into predetermined target output (this is a value smaller than the usual output in the case of the temperature of the heat exchange body 93 less than the predetermined value a in ending the coolant stop control of the control device 10), but gradually changes. Also, when gradually changing the output of the pump 50, the control device 10 may continuously or stepwisely change the output of the pump 50 into the target output.

As the predetermined value a used in step S30, it is possible to use, for example, a temperature at which the heat exchange body 93 may be degraded, in a case of executing the usual control in step S40 without executing step S50 when the temperature of the heat exchanger body 93 is not less than the predetermined value a. The predetermined value a, obtained beforehand by experiment, simulation, or the like, is stored in the storage unit.

In addition, the control device 10 according to the embodiment in step S50 controls the flow rate of the coolant passing through the EGR cooler 90 such that the temperature of the heat exchange body 93 after the coolant stop control ends is not smaller than a predetermined value x smaller than the predetermined value a. That is, in step S50, the control device 10 according to the embodiment reduces the flow rate of the coolant passing through the EGR cooler 90 as compared with the usual flow rate, while controlling the temperature of the heat exchange body 93 not to be smaller than the predetermined value x. The control device 10 ends the execution of the flow chart after step S50.

With the control device 10 according to the embodiment, as described in step S50, the control device 10 controls the flow rate of the coolant passing through the EGR cooler 90 to be small in the case of the temperature of the heat exchange body 93 not less than the predetermined value a in ending the coolant stop control of the control device 10, as compared with the flow rate of the coolant passing through the EGR cooler 90 (usual flow rate) in the case of the temperature of the heat exchange body 93 less than the predetermined value a in ending the coolant stop control of the control device 10. The execution of this control can reduce the degree to which the coolant cools the heat exchange body 93. It is thereby possible to reduce the temperature decrease speed of the heat exchange body 93 in ending the coolant stop control. That is, it is possible to suppress the degree of the temperature change of the heat exchange body 93 in ending the coolant stop control. As a result, it is possible to suppress a sudden decrease in the temperature of the heat exchange body 93 made of a material including SiC when the coolant stop control ends. This can suppress a sudden decrease in the strength of the heat exchange body 93. It is thus possible to suppress the deterioration in the heat exchange body 93.

Further, since the control device 10 gradually changes the output of the pump 50 to the target output in step S50, the sudden change in temperature of the heat exchange body 93 can be effectively suppressed in comparison with the case of suddenly changing the output of the pump 50. Thereby, it is possible to effectively suppress the deterioration in the heat exchange body 93.

(First Variation)

Figure 4:
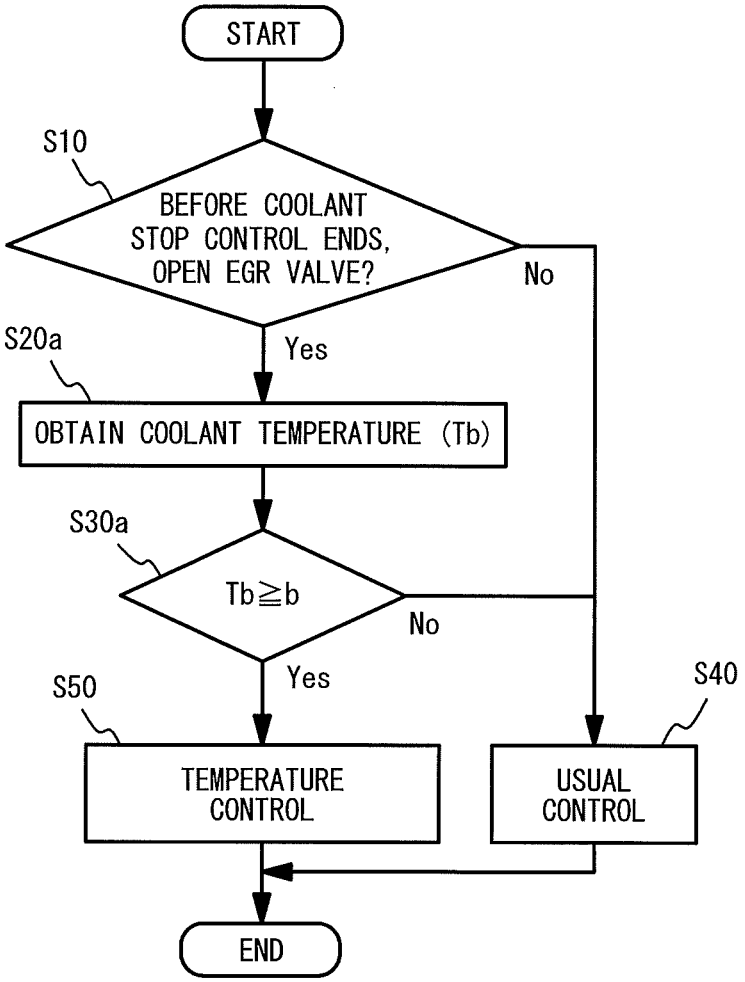
FIG. 4 is a view illustrating an example of a flowchart of temperature control executed by a control device according to the first variation of the first embodiment.

Next, a description will be given of the control device 10 for the internal combustion engine according to the first variation of the first embodiment. The control device 10 according to the variation differs from the control device 10 according to the first embodiment in that a flowchart described later is executed in FIG. 4 instead of FIG. 3. FIG. 4 is a view illustrating an example of a flowchart of the temperature control executed by the control device 10 according to the variation. The flowchart of FIG. 4 differs from the flowchart of FIG. 3 according to the first embodiment in that step S20*a* is provided instead of step S20 and step S30*a* is provided instead of step S30. In addition, the main differences between step S20*a* and step S20 and between step S30*a* and step S30 are that an index correlated with the temperature of the heat exchange body 93 is used instead of the temperature of the heat exchange body 93.

In step S20*a*, the control device 10 according to the variation obtains the index correlated with the temperature of the heat exchange body 93. Herein, the temperature of the coolant tends to increase as the temperature of the heat exchange body 93 increases, and the temperature of the coolant also tends to decrease as the temperature of the heat exchange body 93 decreases. Thus, the temperature of the coolant has a correlation with the temperature of the heat exchange body 93. Accordingly, the control device 10 according to the variation uses the temperature of the coolant as an example of the index correlated with the temperature of the heat exchange body 93. More specifically, the control device 10 uses the temperature of the coolant in the cooler coolant passage 94 as the temperature of the coolant. As a result, the control device 10 according to the variation obtains the temperature of the coolant in the cooler coolant passage 94 (Tb) on the basis of the detection result of the temperature sensor 101*a* in step S20*a*.

Next, the control device 10 in step S30*a* determines whether or not the temperature of the coolant in the cooler coolant passage 94 (Tb) obtained in step S20*a* is not less than a predetermined value b. The predetermined value b is a temperature of the coolant in the cooler coolant passage 94 corresponding to the predetermined value a. Specifically, as the predetermined value b, it is possible to use, for example, a temperature at which the heat exchange body 93 may be degraded, in a case of executing the usual control in step S40 without executing step S50 when the temperature of the cooler coolant passage 94 is not less than the predetermined value b. The predetermined value b, obtained beforehand by experiment, simulation, or the like, is stored in the storage unit.

In addition, when No is determined in step S30*a*, the control device 10 executes step S40. Since step S40 in FIG. 4 is the same as step S40 in FIG. 3, the description thereof is omitted. When Yes is determined in step S30*a*, the control device 10 executes step S50. Step S50 in FIG. 4 is the same as step S50 of FIG. 3. Specifically, in step S50, after the coolant stop control ends, the control device 10 according to the variation controls the flow rate of the coolant passing through the EGR cooler 90 to be small in comparison with the usual flow rate (the coolant flow rate in executing step S40). That is, the control device 10 (specifically, the CPU 11) according to the variation controls the flow rate of the coolant passing through the EGR cooler 90 to be small, in the case of the temperature of the coolant not less than the predetermined value b in ending the coolant stop control of the control device 10, as compared with the case of the temperature of the coolant less than the predetermined value b in ending the coolant stop control of the control device 10.

More specifically, in step S50, after the coolant stop control ends, the control device 10 according to the variation reduces the output of the pump 50 as compared with the usual output (this is the output of the pump 50 in executing step S40). In other words, the control device 10 according to the variation reduces the output of the pump 50, in the case of the temperature of the coolant not less than the predetermined value b in ending the coolant stop control of the control device 10, as compared with the output of the pump 50 in the case of the temperature of the coolant less than the predetermined value b in ending the coolant stop control of the control device 10. This configuration can control the flow rate of the coolant passing through the EGR cooler 90 to be small, in the case of the temperature of the coolant not less than the predetermined value b in ending the coolant stop control of the control device 10, as compared with the case of the temperature of the coolant less than the predetermined value b in ending the coolant stop control of the control device 10. Further, when reducing the output of the pump 50 in the case of the temperature of the coolant not less than the predetermined value b in ending the coolant stop control of the control device 10 in comparison with the output of the pump 50 in the case of the temperature of the coolant less than the predetermined value b in ending the coolant stop control of the control device 10 in step S50, the control device 10 gradually changes the output of the pump 50 into predetermined target output (this is a value smaller than the usual output in the case of the temperature of the coolant less than the predetermined value b in ending the coolant stop control of the control device 10). Also, when gradually changing the output of the pump 50, the control device 10 may continuously or stepwisely change the output of the pump 50 into the target output.

Also, the control device 10 according to the variation can achieve the same effects as the first embodiment. Specifically, also in the control device 10 according to the variation, the execution of step S50 can reduce the degree to which the coolant cools the heat exchange body 93 in ending the coolant stop control. Thereby, it is possible to reduce the temperature decrease speed of the heat exchange body 93 in ending the coolant stop control. As a result, it is possible to suppress the sudden decrease in the temperature of the heat exchange body 93 in ending the coolant stop control, thereby suppressing the deterioration in the heat exchange body 93.

Also, since the control device 10 according to the variation gradually changes the output of the pump 50 into the target output in step S50, it is possible to effectively suppress a sudden change in the temperature of the heat exchange body 93, as compared to a case of suddenly changing the output of the pump 50. It is thus possible to effectively suppress the deterioration in the heat exchange body 93.

Additionally, in the first embodiment and the first variation of the first embodiment, the control device 10 controls the pump 50 to execute the temperature control, but it is not limited thereto. For example, in a case of the internal combustion engine 5 provided with a configuration other than the pump 50 as a coolant flow rate adjustment mechanism capable of adjusting the flow rate of the coolant flowing into the EGR cooler 90, the control device 10 may control this to execute the temperature control. As an example of this, for example, in a case of the internal combustion engine 5 provided at the second supply passage 62 or the second discharge passage 63 with a coolant flow rate adjustment valve as the coolant flow rate adjustment mechanism other than the pump 50, the control device 10 may control the opening degree of the control valve to execute the temperature control.

In the first embodiment and the first variation of the first embodiment, the CPU 11, executing the coolant stop control, corresponds to a member having a function as a coolant stop control unit for executing the coolant stop control. Also, the CPU 11, executing step S50, corresponds to a member having a function as a control unit for controlling the flow rate of coolant passing through the EGR cooler 90 and as a control unit for controlling the output of the pump 50.

Second Embodiment

Figure 5:
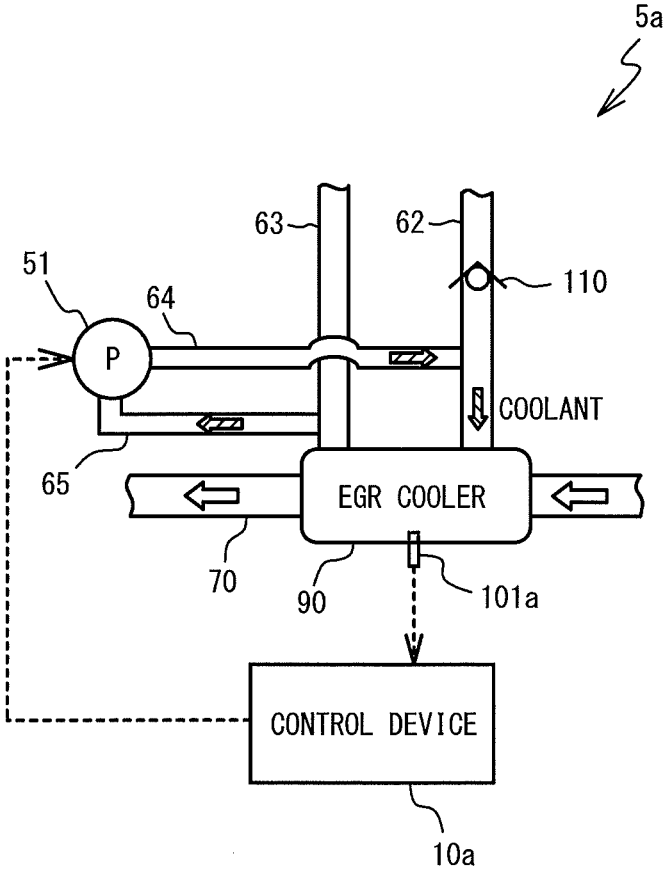
FIG. 5 is a schematic view for describing structure of an internal combustion engine according to the second embodiment.

Next, a description will be given of a control device 10*a* for the internal combustion engine according to the second embodiment of the present invention. First, a description will be given of structure of an internal combustion engine 5*a* into which the control device 10*a* is applied, and then a description will be given of the control device 10*a*. FIG. 5 is a schematic view for describing the structure of the internal combustion engine 5*a*. FIG. 5 specifically illustrates the structure around the EGR cooler 90 of the internal combustion engine 5*a* and the control device 10*a*. The internal combustion engine 5*a* differs from the internal combustion engine 5 illustrated in FIG. 1 in that the control device 10*a* is provided instead of the control device 10 and that a second pump 51, a third supply passage 64, a third discharge passage 65, and a check valve 110 are further provided. Note that although being not illustrated in FIG. 5, each component other than the control device 10 illustrated in FIG. 1 is also provided in the internal combustion engine 5*a*.

The second pump 51 is another pump different from the pump 50. That is, that internal combustion engine 5*a* according to the embodiment is provided with two pumps (the pump 50 and the second pump 51). The second pump 51 supplies the coolant to the EGR cooler 90 in accordance with instructions from the control device 10*a*. That is, the second pump 51 is a pump provided separately from the pump 50 and supplying the coolant to the EGR cooler 90. In the embodiment, as an example of the second pump 51, an electric water pump is used. The specific structure of the second pump 51 is not, however, limited to the electric water pump, as long as it can supply the coolant in response to instructions from the control device 10*a*.

The third supply passage 64 communicates the second pump 51 with the second supply passage 62. The third supply passage 64 is a coolant passage for introducing the coolant discharged from the second pump 51 to the second supply passage 62. The third discharge passage 65 communicates the second pump 51 with the second discharge passage 63. The third discharge passage 65 is a coolant passage for returning the coolant flowing into the second discharge passage 63 through the EGR cooler 90 to the second pump 51. The check valve 110 is arranged on the upstream side with respect to a point of the second supply passage 62 to which the third supply passage 64 is connected in the coolant flow direction. The check valve 110 allows the coolant to pass through the second supply passage 62 from the engine body 20 side to the EGR cooler 90 side, and suppresses the coolant from passing from the EGR cooler 90 side to the engine body 20 side. The internal combustion engine 5*a* is provided with the check valve 110, thereby suppressing the coolant flowing into the second supply passage 62 through the third supply passage 64 from flowing into the engine body 20 when the second pump 51 operates while the pump 50 stops.

Figure 6:
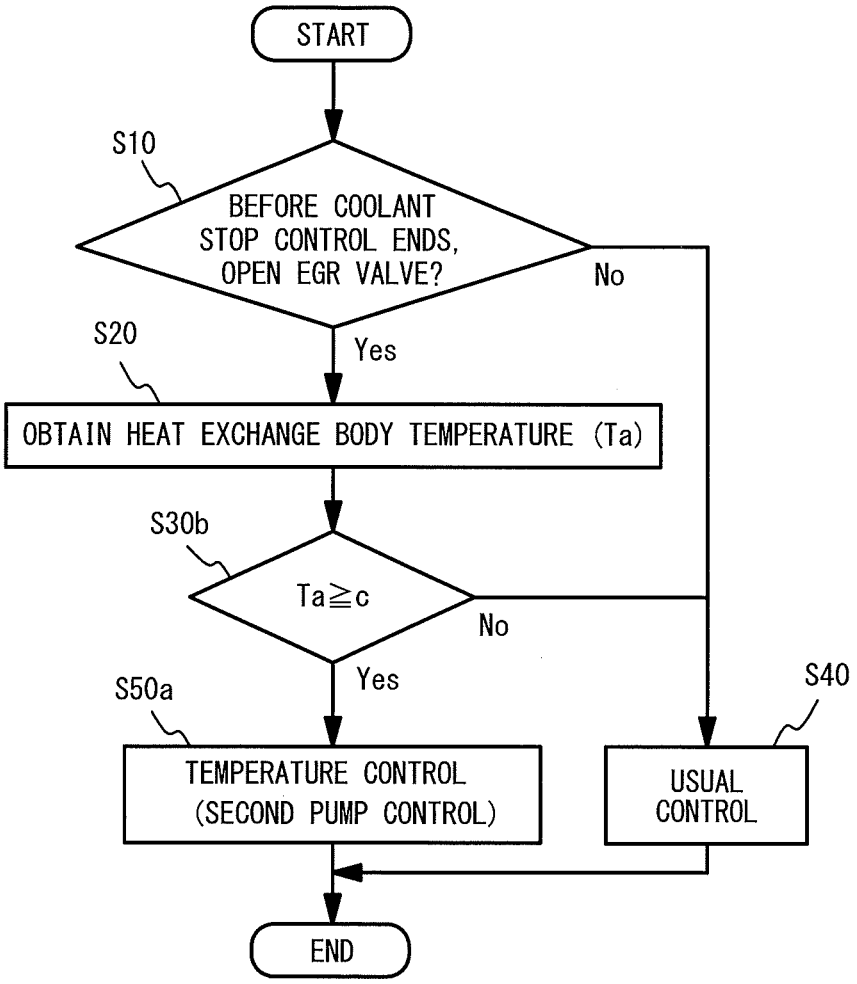
FIG. 6 is a view illustrating an example of a flowchart of temperature control executed by a control device according to the second embodiment.

The control device 10*a* will be described in detail. A hardware configuration of the control device 10*a* is the same as the control device 10 of FIG. 1. Like the control device 10, the control device 10*a* according to the embodiment is an electronic control device including the CPU 11, the ROM 12 and the RAM 13. The control device 10*a* differs from the control device 10 according to the first embodiment in that a flowchart of FIG. 6 to be described later is executed in place of the flowchart of FIG. 3. FIG. 6 is a view illustrating an example of the flowchart of the temperature control executed by the control device 10*a* according to the embodiment. The flowchart of FIG. 6 differs from the flowchart of FIG. 3 in that step S30*b* is provided instead of Step S30 and that step S50*a* is provided instead of step S50.

In step S30*b*, the control device 10*a* (Specifically, the CPU 11) determines whether or not the temperature of the heat exchange body 93 (Ta) obtained in step S20 is not less than a predetermined value c. Note that step S30*b* is executed before the coolant stop control ends. When No is determined in step S30*b*, the control device 10*a* executes the usual control of step S40. Specifically, the control device 10*a* in step S40 controls the flow rate of the coolant passing through the EGR cooler 90 to be the usual flow rate after the coolant stop control ends. In addition, when controlling the flow rate of the coolant to the usual flow rate in step S40, the second pump 51 controls the flow rate of the coolant to the usual flow rate by controlling the pump 50 without operating the second pump 51. Additionally, since the specific content of step S40 according to the embodiment is the same as step S40 in the first embodiment, a further detailed description thereof is omitted.

When Yes is determined in step S30*b*, the control device 10*a* executes the temperature control of step S50*a*. In step S50*a*, the control device 10*a* starts operating the second pump 51. That is, the control device 10*a* according to the embodiment executes the temperature control of step S50*a* when the heat exchange body 93 is not less than the predetermined value c before the coolant stop control ends, and the control device 10*a* in step S50*a* starts operating the second pump 51. The execution of step S50*a* results in starting the operation of the second pump 51 according to the embodiment before the coolant stop control ends (specifically, before the operation of the pump 50 starts). Subsequently, the control device 10*a* ends the execution of the flow chart.

The control device 10*a* according to the embodiment executes the temperature control of step S50*a*, thereby reducing the temperature of the heat exchange body 93 when the coolant stop control ends, as compared with a case of not starting the operation of the second pump 51 nevertheless the temperature of the heat exchange body 93 is not less than the predetermined value c before the coolant stop control ends. As a result, it is possible to reduce the temperature decrease amount of the heat exchange body 93 in ending the coolant stop control. It is thus possible to suppress the sudden decrease in the temperature of the heat exchange body 93 in ending the coolant stop control, thereby suppressing the deterioration in the heat exchange body 93.

In addition, the control device 10*a* may control the second pump 51 such that the temperature of the heat exchange body 93 in ending the coolant stop control does not exceed a second predetermined value y, after starting the operation of the second pump 51 in step S50*a*. As this second predetermined value y, it is possible to use a predetermined temperature lower than the temperature of the heat exchange body 93 (hereinafter, referred to as temperature z), which is in ending the coolant stop control in the case where the operation of the second pump 51 does not starts nevertheless the temperature of the heat exchange body 93 is not less than the predetermined value c before the coolant stop control ends. Specifically, in this case, the output of the second pump 51 (specifically, rotational speed), which causes the temperature of the heat exchange body 93 in ending the coolant stop control not to exceed the second predetermined value y, is calculated beforehand and stored in the storage unit of the control device 10*a*. When Yes is determined in step S30*b* and the operation of the second pump 51 starts in step S50*a*, the control device 10*a* controls the output of the second pump 51 to be the output of the second pump 51 stored in this storage unit. With this configuration, the temperature of the heat exchange body 93 in ending the coolant stop control can be suppressed to be lower than the second predetermined value y. This results in that the temperature of the heat exchange body 93 in ending the coolant stop control can be adequately reduced as compared with the temperature z. Accordingly, it is possible to more effectively suppress the deterioration in the heat exchange body 93.

Note that the predetermined value c used in step S30*b* is preferably a temperature to suppress the deterioration in the heat exchange body 93 when No is determined in step S30*b* and the usual control is executed in step S40. This is because, in this case, the deterioration of the heat exchange body 93 can be suppressed even when step S40 according to the embodiment is executed. The predetermined value c, calculated by experiments, simulation, or the like beforehand, is stored in the storage unit.

(Variation 1)

Figure 7:
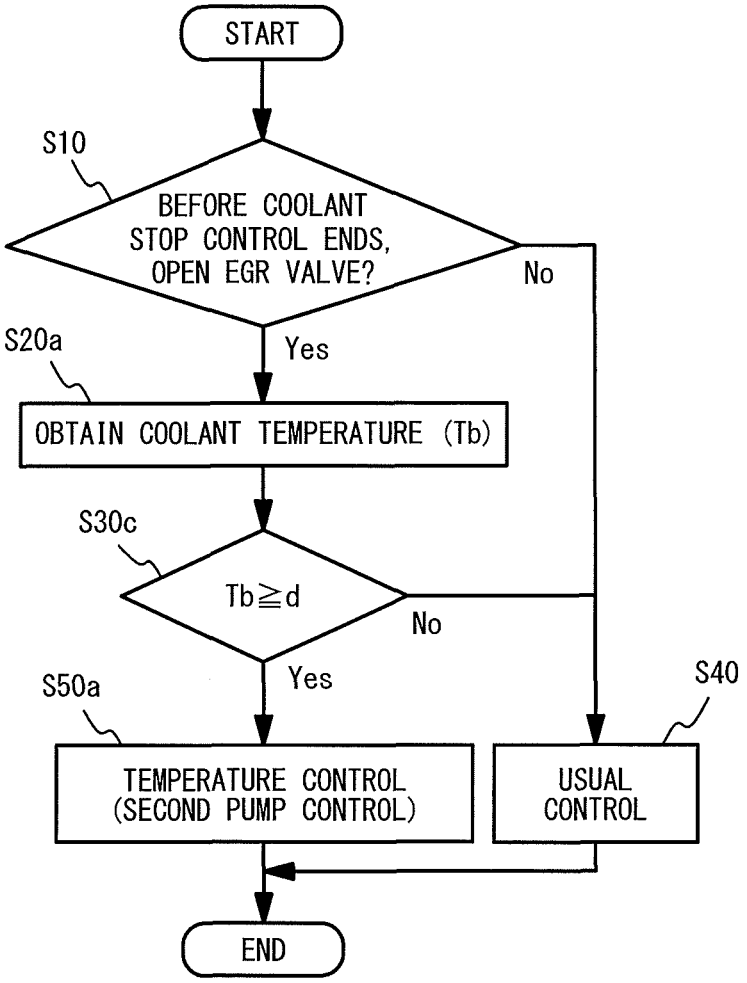
FIG. 7 is a view illustrating an example of a flowchart of temperature control executed by a control device according to the first variation of the second embodiment.

Next, a description will be given of the control device 10*a* of the internal combustion engine according to the first variation of the second embodiment. The control device 10*a* according to the variation differs from the control device 10*a* according to the second embodiment in that a flowchart described later is executed in FIG. 7 instead of FIG. 6. FIG. 7 is a view illustrating an example of a flowchart of the temperature control executed by the control device 10*a* according to the variation. The flowchart of FIG. 7 differs from the flowchart of FIG. 6 in that step S20*a* is provided instead of step S20 and that step S30*c* is provided instead of step S30*b*. In addition, the main differences between step S20*a* and step S20 and between step S30*c* and step S30*b* are that an index correlated with the temperature of the heat exchange body 93, that is, the temperature of the coolant in the cooler coolant passage 94 is used instead of the temperature of the heat exchange body 93.

Step S20*a* of FIG. 6 is the same as step S20*a* in FIG. 4. Specifically, in step S20*a*, the control device 10*a* according to the variation obtains the temperature of the coolant in the cooler coolant passage 94 (Tb) on the basis of the detection result of the temperature sensor 101*a*. The control device 10*a* executes step S30*c* after step S20*a*.

In step S30*c*, the control device 10*a* determines whether or not the temperature of the coolant (Tb) obtained in step S20*a* is not less than a predetermined value d. The predetermined value d is a temperature of the coolant in the cooler coolant passage 94 corresponding to the predetermined value c in step S30*b* of FIG. 6. Specifically, the predetermined value d is preferably a temperature to suppress the deterioration in the heat exchange body 93 when No is determined in step S30*c* and the usual control is executed in step S40.

When No is determined in step S30*c*, the control device 10*a* executes step S40. As step S40 is the same as step S40 in FIG. 6, the description thereof is omitted. When Yes is determined in step S30*c*, the control device 10*a* executes the temperature control in step S50*a*. Since step S50*a* is the same as step S50*a* in FIG. 6, the description thereof is omitted.

As described above, the control device 10*a* according to the variation executes the temperature control according to step S50*a* when the temperature of the coolant (specifically, the temperature of the coolant in the cooler coolant passage 94) is not less than the predetermined value d before the coolant stop control ends, and the control device 10*a* starts the operation of the second pump 51 in the temperature control. The execution of this temperature control allows even the control device 10*a* according to this variation to suppress the sudden decrease in the temperature of the heat exchange body 93 in ending the coolant stop control for the same reason as the second embodiment. Thereby, it is possible to suppress the sudden decrease in the strength of the heat exchange body 93, thereby suppressing the deterioration in the heat exchange body 93.

Additionally, in the second embodiment and the first variation of the second embodiment, the CPU 11, executing the coolant stop control, corresponds to a member functioning as a coolant stop control unit for executing the coolant stop control. Also, the CPU 11, executing step S50*a*, corresponds to a member functioning as a control unit for controlling the second pump 51.

Figure 8A:
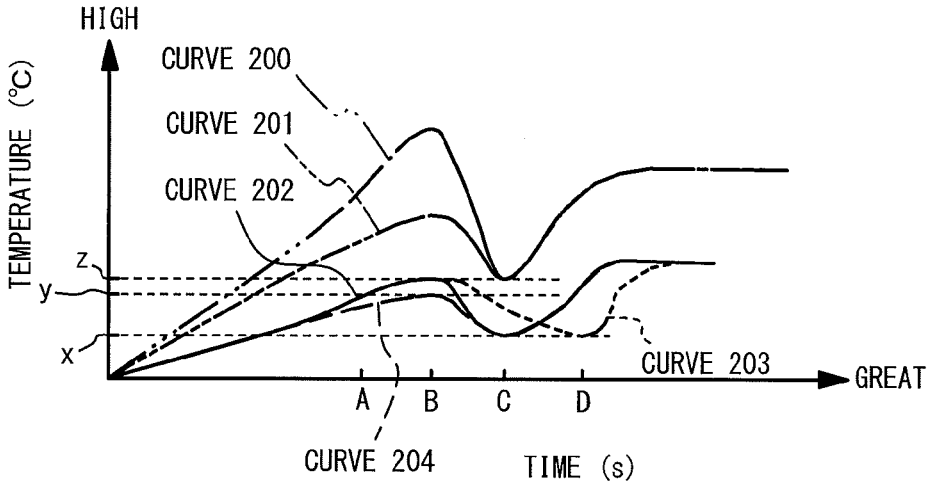
FIG. 8A is a schematic diagram for describing a change in temperature of a heat exchange body in executing the temperature control according to the first embodiment and the second embodiment.
Figure 8B:
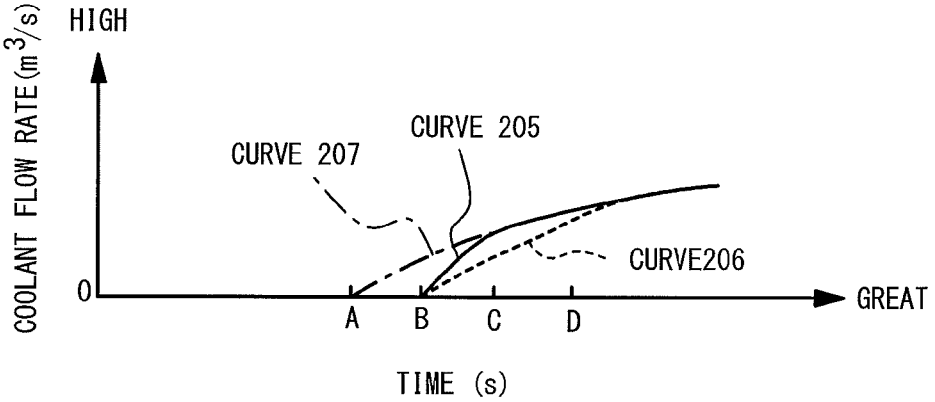
FIG. 8B is a schematic diagram for describing a change in flow rate of coolant in a cooler coolant passage in executing the temperature control according to the first embodiment and the second embodiment.
Figure 9:
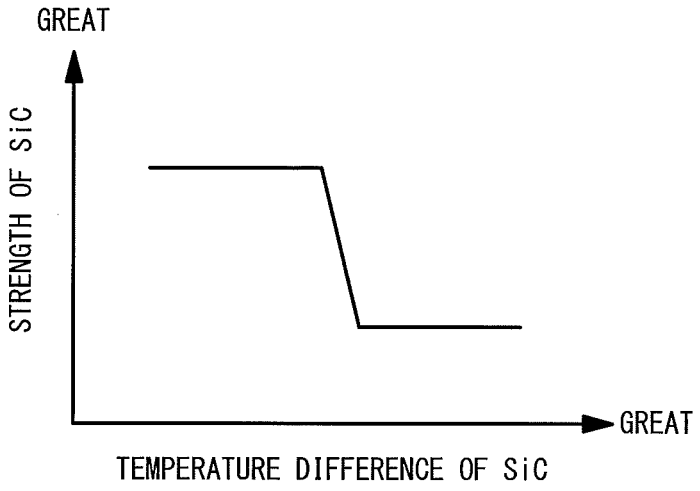
FIG. 9 is a schematic view of a change in strength of SiC with temperature.

Next, in order to facilitate the understanding of the differences between the temperature control according to the second embodiment and the temperature control according to the first embodiment in effects, the effects of the temperature control according to the first embodiment and the second embodiment are summarized with reference the drawings. FIG. 8A is a schematic diagram for describing a change in the temperature of the heat exchange body 93 in executing the temperature control according to the first embodiment and the second embodiment. FIG. 8B is a schematic diagram for describing a change in the flow rate of the coolant in the cooler coolant passage 94 in executing the temperature control according to the first embodiment and the second embodiment.

The vertical axis in FIG. 8A indicates the temperature, and the horizontal axis indicates time. A curve 200 represents a change in the temperature of the coolant in the cooler coolant passage 94 with time, and a curve 201 represents a change in the temperature of the coolant in the engine body coolant passage of the engine body 20 with time. A curve 202 represents a change in the temperature of the heat exchange body 93 with time, in a case of executing step S40 instead of step S50 in determining Yes in step S30 (hereinafter, this case is referred to as a case of executing the control according to the comparative example). That is, that comparative example represented with the curve 202 indicates the change in the temperature of the heat exchange body 93 with time, in a case where the coolant has flowed into the EGR cooler 90 at the usual flow rate after the coolant stop control ends, when Yes is determined in step S30. A curve 203 represents a change in the temperature of the heat exchange body 93 with time in a case of executing the temperature control according to the first embodiment. A curve 204 represents a change in the temperature of the heat exchange body 93 with time in a case of executing the temperature control according to the second embodiment. Specifically, the curve 204, in the temperature control according to step S50*a*, represents the change in the temperature of the heat exchange body 93 with time, in a case of controlling the second pump 51 such that the temperature of the heat exchange body 93 in ending the coolant stop control does not exceed the second predetermined value y. Also in a case of executing the temperature control according to the first variation of the first embodiment and the first variation of the second embodiment, the same diagram of FIG. 8A is obtained.

The vertical axis in FIG. 8B indicates the coolant flow rate in the cooler coolant passage 94, and the horizontal axis indicates time. A curve 205 represents a change in the coolant flow rate in the cooler coolant passage 94 with time in a case of executing the usual control according to the comparative example. A curve 206 represents a change in the coolant flow rate in the cooler coolant passage 94 according to the first embodiment with time. Note that the curve 206 meets a part of the curve 205. A curve 207 represents a change in the coolant flow rate in the cooler coolant passage 94 according to the second embodiment with time. Note that the curve 207 meets a part of the curve 205. Also in a case of executing the temperature control according to the first variation of the first embodiment and the first variation of the second embodiment, the same diagram of FIG. 8B is obtained.

In FIG. 8A and FIG. 8B, time A is time when the temperature of the heat exchange body 93 is not less than the predetermined value c in step S30*b* of FIG. 6 according to the second embodiment. Time B is time when the coolant stop control ends in the first embodiment and the second embodiment. With reference to the curve 207, the second pump 51 starts operating at time A, so that the coolant flow rate of the cooler coolant passage 94 starts increasing at the time A. In FIG. 8A and FIG. 8B, time C is time when the temperature of the heat exchange body 93 is lowest after the coolant stop control ends in the case of executing the control according to the comparative example (curve 202). Time D is time when the temperature of the heat exchange body 93 is lowest after the coolant stop control ends in the case of executing the temperature control according to the first embodiment (curve 203).

As seen in comparison between the curve 206 (the temperature control in the first embodiment) and the curve 205 (the comparative example) in FIG. 8B, the execution of the temperature control according to the first embodiment controls the coolant flow rate, in the cooler coolant passage 94 after the coolant stop control according to the first embodiment ends, to be smaller than the usual flow rate (thus, the curve 206 is located under the curve 205). Accordingly, as seen in caparison between the curve 203 (the temperature control in the first embodiment) and the curve 202 (the comparative example) of FIG. 8A, time D when the temperature of the heat exchange body 93 is lowest in the first embodiment exceeds time C when the temperature of the heat exchange body 93 is lowest in the comparative example. Thus, it is seen that the temperature decrease speed of the heat exchange body 93 after the coolant stop control ends is reduced in the temperature control according to the first embodiment, as compared with the case of executing the control according to the comparative example. Accordingly, the execution of the temperature control according to the first embodiment can suppress the sudden decrease in the temperature of the heat exchange body 93 after the coolant stop control ends.

As also seen in comparison between the curve 204 (the temperature control in the second embodiment) and the curve 202 (the comparative example) in FIG. 8A, the temperature of the heat exchange body 93 in ending the coolant stop control in the second embodiment (the temperature of the heat exchange body 93 at time B) is low, as compared with the temperature z of the heat exchange body 93 in ending the coolant stop control in the case of not starting the operation of the second pump 51 nevertheless the temperature of the heat exchange body 93 is not less than the predetermined value c before the coolant stop control ends (for example, in the case of executing the control according to the comparative example represented by the curve 202, or the case of executing the control according to the first embodiment represented by the curve 203). It thus can be seen that the execution of the temperature control according to the second embodiment reduces the temperature decrease degree of the heat exchange body 93 after the coolant stop control ends. Accordingly, the execution of the temperature control according to the second embodiment suppresses the sudden decrease in the temperature of the heat exchange body 93 after the coolant stop control ends.

While the exemplary embodiments of the present invention have been illustrated in detail, the present invention is not limited to the above-mentioned embodiments, and other embodiments, variations and modifications may be made without departing from the scope of the present invention.

DESCRIPTION OF LETTERS OR NUMERALS

5 internal combustion engine
10 control device
20 engine body
21 cylinder
30 intake passage
31 exhaust passage
50 pump
51 second pump
70 EGR passage
80 EGR valve
90 EGR cooler
93 heat exchanger
94 cooler coolant passage

The invention claimed is:

1. A control device for an internal combustion engine, the control device that is applied to the internal combustion engine including an Exhaust Gas Recirculation (EGR) cooler which is arranged in an EGR passage introducing an EGR gas into an intake passage of the internal combustion engine and which includes a heat exchange body made of a material including SiC, the control device comprising:

a coolant stop control unit that executes coolant stop control to stop a coolant from flowing into the EGR cooler; and a control unit that controls a flow rate of the coolant passing through the EGR cooler to be small in a case of a temperature of the coolant not being less than a predetermined value before the coolant stop control ends in the coolant stop control unit, as compared with a case of a temperature of the coolant being less than the predetermined value before the coolant stop control ends in the coolant stop control unit.

2. The control device for the internal combustion engine of claim 1, wherein the internal combustion engine includes a pump that supplies a coolant to an engine body and the EGR cooler, the control unit reduces output of the pump, in a case of the temperature of the coolant not being less than the predetermined value before the coolant stop control ends in the coolant stop control unit, as compared with a case of the temperature of the coolant being less than the predetermined value before the coolant stop control ends in the coolant stop control unit.

3. The control device for the internal combustion engine of claim 2, wherein the control unit gradually changes output of the pump to a target output, when reducing output of the pump.

* * * * *